US011144011B2

(12) United States Patent
de Almeida Graça et al.

(10) Patent No.: US 11,144,011 B2
(45) Date of Patent: Oct. 12, 2021

(54) DEVICE FOR WINDING A TIMEPIECE MOVEMENT

(71) Applicant: ROLEX SA, Geneva (CH)

(72) Inventors: Sergio de Almeida Graça, Bienne (CH); Vannina Linck, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/667,718

(22) Filed: Aug. 3, 2017

(65) Prior Publication Data

US 2018/0046141 A1 Feb. 15, 2018

(30) Foreign Application Priority Data

Aug. 15, 2016 (EP) ..... 16184191

(51) Int. Cl.

| | |
|---|---|
| ***G04B 11/02*** | (2006.01) |
| ***G04B 3/00*** | (2006.01) |
| ***G04B 5/00*** | (2006.01) |
| ***G04B 7/00*** | (2006.01) |
| ***G04B 13/02*** | (2006.01) |
| ***G04B 27/04*** | (2006.01) |

(52) U.S. Cl.
CPC ..... *G04B 3/006* (2013.01); *G04B 5/00* (2013.01); *G04B 7/00* (2013.01); *G04B 11/024* (2013.01); *G04B 13/026* (2013.01); *G04B 27/04* (2013.01)

(58) Field of Classification Search
CPC ..... G04B 5/00; G04B 7/00; G04B 27/04; G04B 11/024; G04B 13/026; G04B 3/006
See application file for complete search history.

(56) References Cited

U.S. PATENT DOCUMENTS 3,629,624 A * 12/1971 Staudte ..... H02N 1/004 310/309
3,772,096 A * 11/1973 Maquelin ..... G04B 37/221 148/217
4,056,743 A * 11/1977 Clifford ..... H02K 7/065 310/21
7,950,846 B2 * 5/2011 Hessler ..... G04B 17/20 368/127
9,182,742 B2 11/2015 Von Gruenigen et al.
(Continued)

FOREIGN PATENT DOCUMENTS

DE 102009005357 A1 8/2010
EP 2 757 423 A1 7/2014
(Continued)

OTHER PUBLICATIONS

European Search Report and Written Opinion dated Feb. 20, 2017 issued in counterpart application No. EP16184191; w/ English partial translation and partial machine translation (18 pages).
(Continued)

*Primary Examiner* — Sean Kayes
(74) *Attorney, Agent, or Firm* — Seckel IP, PLLC

(57) ABSTRACT

A component of a winding device, in particular an automatic winding device, of a timepiece movement, wherein it is made of austenitic stainless steel and wherein it comprises at least one friction surface hardened by carbon or nitrogen type atoms introduced into the austenitic stainless steel over a predetermined depth.

21 Claims, 3 Drawing Sheets

(56) References Cited

U.S. PATENT DOCUMENTS

| | | | | |
|---|---|---|---|---|
| 2002/0114225 | A1* | 8/2002 | Damasko | G04B 15/14 368/125 |
| 2002/0191493 | A1* | 12/2002 | Hara | F16F 1/024 368/140 |
| 2008/0194377 | A1* | 8/2008 | Mordukhovich | G04B 13/02 475/331 |
| 2010/0002548 | A1* | 1/2010 | Hessler | G04B 17/06 368/129 |
| 2011/0123815 | A1* | 5/2011 | Kawakami | B44D 5/00 428/457 |
| 2014/0198625 | A1* | 7/2014 | Von Gruenigen | G04B 1/16 368/124 |
| 2015/0013460 | A1* | 1/2015 | Favre | G04D 7/001 73/579 |

FOREIGN PATENT DOCUMENTS

| | | | |
|---|---|---|---|
| JP | 2001073110 | A | 3/2001 |
| JP | 2002266078 | A | 9/2002 |
| JP | 2002323114 | A | 11/2002 |
| JP | 2003-214526 | A | 7/2003 |
| JP | 2004502910 | A | 1/2004 |
| JP | 2004301636 | A | 10/2004 |
| JP | 2005241374 | A | 9/2005 |
| JP | 2010014717 | A | 1/2010 |
| JP | 2014137376 | A | 7/2014 |
| WO | WO 2017/068538 | * | 4/2017 |

OTHER PUBLICATIONS

Japanese Office Action and Search Report dated Jun. 8, 2021 issued in counterpart application No. JP 2017-147492; w/ English machine translation (34 pages).

* cited by examiner

DEVICE FOR WINDING A TIMEPIECE MOVEMENT

This application claims priority of European patent application No. EP16184191.1 filed Aug. 15, 2016, the contents of which are hereby incorporated herein in their entirety.

The invention relates to a component of a winding device, in particular an automatic winding device, of a timepiece movement and also to a winding device, in particular an automatic winding device, to a timepiece movement and to a timepiece as such, comprising such a component. It also relates to a process for manufacturing a component of a winding device, more generally of a timepiece movement.

An automatic winding device of the prior art makes it possible, via a kinematic chain, to connect an oscillating weight to a barrel, so as to enable the winding-up of a barrel spring.

FIG. 1 illustrates more particularly a portion of a mobile element of a kinematic chain of an automatic winding device of the prior art. This mobile element comprises in particular two clicks 1, 2 that cooperate with a toothed wheel 3 that is attached to a pinion 4. In a first automatic winding mode, corresponding to a first direction of rotation of the oscillating mass, the toothed wheel 3 and the pinion 4 are rotated under the action of the clicks 1, 2 which are both pivoted on an automaton wheel, not represented in FIG. 1, itself rotated in a first direction of rotation. In a second automatic winding mode, corresponding to a second direction of rotation of the oscillating mass, the clicks 1 and 2 have no effect on the toothed wheel 3 and the pinion 4, and oscillate at high speed relative to the toothed wheel 3, about their respective pivoting axis, under the rotation of the automaton wheel in a second direction of rotation. In a third manual winding mode, the pinion 4 and the toothed wheel 3 are rotated under the effect of a manual winding chain. The rotation of the wheel 3 disengages the teeth of the wheel 3 from the clicks 1 and 2 which oscillate at high speed, or even at very high speed, about their respective pivoting axis.

These three winding modes, well known from the automaton devices of the applicant, are especially rendered possible by the asymmetric conformation of the teeth of the wheel 3, and also by the specific geometry of the clicks 1, 2, in particular of the beaks of the clicks 1, 2. In the three modes, the beaks of the clicks 1, 2 cooperate with the teeth of the toothed wheel 3 and there is a friction torque between the friction surfaces of these components, which generates wear phenomena with aging. The second and third winding modes stress the components more greatly on the tribological level due to the oscillations at high speed, or even at very high speed, of the clicks: specifically, friction rates are measured in the case of a click of at least 5 kHz in manual winding, which may even exceed 10 kHz. By way of indication, the oscillation frequencies of the axes of a mechanical oscillator of a timepiece movement are in general of the order of 3 to 5 Hz, which represents very different stresses than those of a winding device. The clicks and the toothed wheel are in general stamped from steels of Ck60, Finemac or 20AP type. With these embodiments from the prior art, pronounced wear appears during advanced aging of the automaton device, as is described in detail below. This wear degrades the efficiency of the automaton and this leads to a risk of loss of winding performance after advanced aging.

FIGS. 3*a* and 3*b* specifically represent the friction surfaces of a click from the prior art made of Ck60 steel after aging, respectively as a chemical contrast scanning electron microscopy (SEM) image and as an optical microscopy image. It appears that a large portion of the surface of the functional zone, identifiable by darker zones in these figures, has changed with the aging. FIG. 4 illustrates the results of the chemical analysis of these surfaces by EDX microprobe: the dark zones correspond to the presence of oxidation products, which turn out to be iron oxide.

The pronounced formation of oxide on the friction surfaces is typical of the tribo-oxidation mechanism. Furthermore, the optical images show more specifically that the oxide on the surfaces has a brown to red color, typical of hematite ($Fe_2O_3$), which is a mineral, the hardness of which is substantially 1000-1100 HV, which originates from waste of mixtures of oxides that form on the two surfaces in contact before becoming encrusted on each surface. The initial Ck60 steel has a hardness of the order of 720 HV. The mineral deposited with aging consequently has a high abrasion potential relative to the softer metal surfaces. The waste generated by the tribo-oxidation is therefore one of the causes of the degradation of the performances observed during the aging of the winding device from the prior art. The applicant has therefore identified, for the first time, the presence of a corrosion phenomenon that appears at the interface between the two components of the winding device and more specifically the appearance of an iron oxide, which causes accelerated wear.

Moreover, the overall aging of a winding system is also linked to the wear of components other than those of a winding device as described in detail above: the solution of the prior art is based on a winding device that therefore accentuates the overall wear of a winding system.

The objective of the present invention is to propose an improved solution for a winding device, in particular an automatic winding device, of a timepiece movement, which does not comprise all or some of the drawbacks of the prior art.

Thus, a general objective of the invention is to propose a timepiece movement winding device that has improved behavior with respect to advanced aging relative to the solutions of the prior art. For this, the invention seeks to achieve one of the following two subjects:

- a first subject consists of a timepiece movement winding device which has a substantially constant performance over time; or, more ambitiously,
- a second subject consists of a timepiece movement winding device which has a performance that increases with time in order to reduce, as much as possible, the overall aging of a winding system.

More specifically, the invention therefore seeks a solution of components for a timepiece movement winding device that withstands corrosion better, even at very high friction frequencies, in particular greater than or equal to 5 kHz.

For this purpose, the invention is based on a component of a winding device, in particular an automatic winding device, of a timepiece movement, wherein it is made of austenitic stainless steel and wherein it comprises at least one friction surface hardened by reinforcing atoms introduced into the austenitic stainless steel over a predetermined depth.

More specifically, the invention is based on a winding device, in particular an automatic winding device, of a timepiece movement, comprising two metal components that cooperate through an interface that is subjected to friction, wherein it comprises at least one austenitic stainless steel component, comprising at least one friction surface hardened by carbon or nitrogen type atoms introduced into the austenitic stainless steel over a predetermined depth.

The invention is more specifically defined by the claims.

These subjects, features and advantages of the present invention will be disclosed in detail in the following description of one particular embodiment given non-limitingly in connection with the appended figures, among which:

Figure 3A:
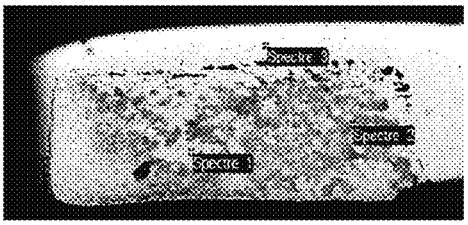
Fig. 3a PRIOR ART
Figure 3B:
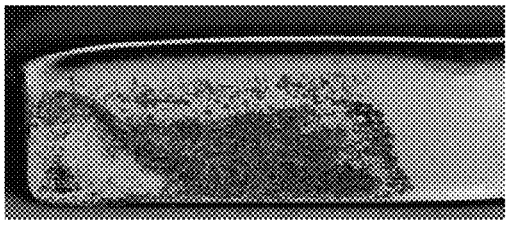
Fig. 3b PRIOR ART

FIGS. 3*a* and 3*b* represent the friction surfaces of a click from the prior art made of Ck60 steel after aging.

Figure 4:
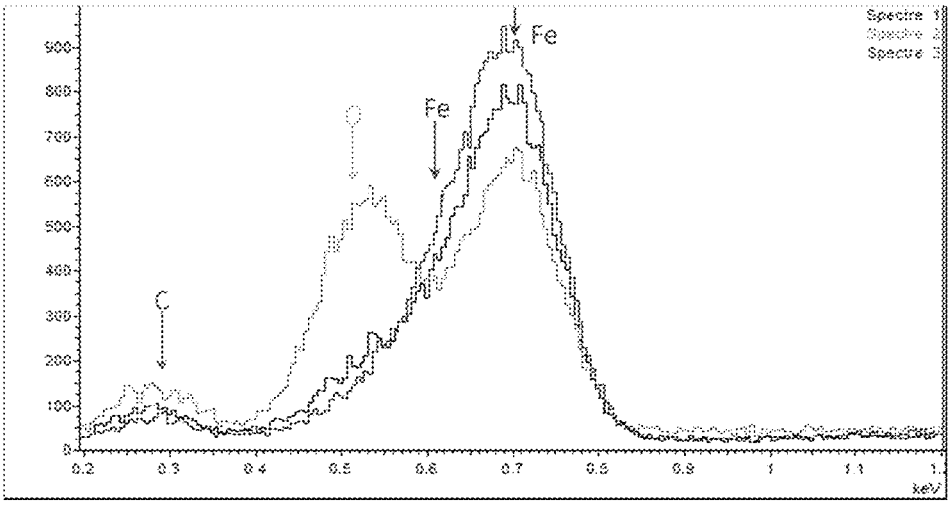

FIG. 4 illustrates the results of the chemical analysis of the friction surfaces from FIGS. 3*a* and 3*b* of the click from the prior art by EDX microprobe.

Figure 5A:
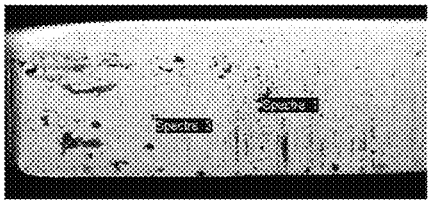
Figure 5B:
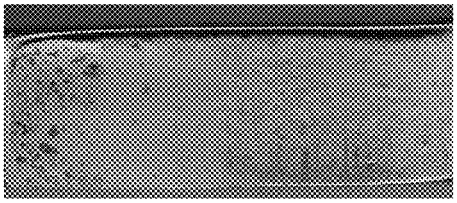

FIGS. 5*a* and 5*b* represent the friction surfaces of a click after aging according to one embodiment of the invention.

Figure 6:
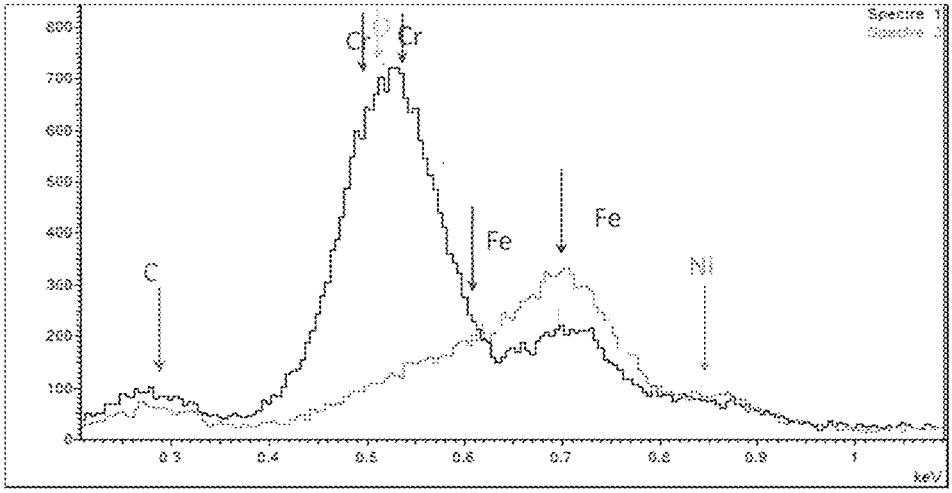

FIG. 6 illustrates the results of the chemical analysis of these friction surfaces from FIGS. 5*a* and 5*b* of the click according to the embodiment of the invention by EDX microprobe.

Figure 7:
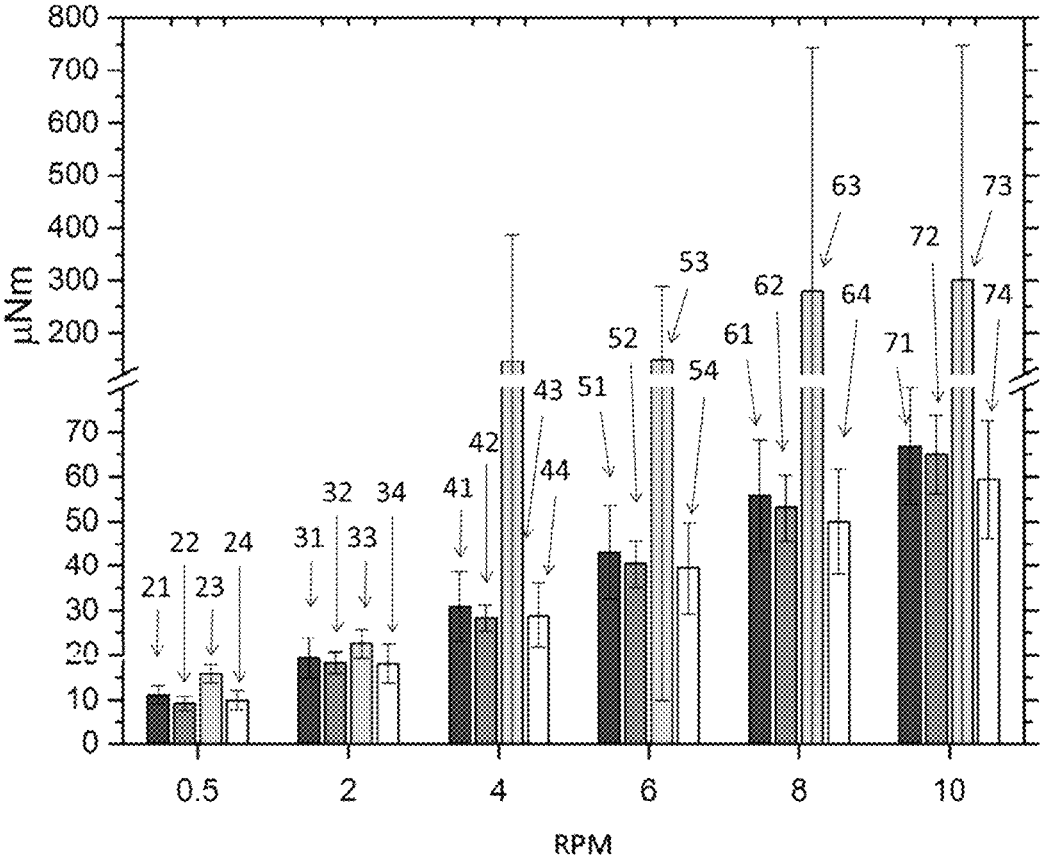

FIG. 7 represents the results of comparative tests of clicks from the prior art and from the embodiment of the invention.

According to the embodiment that will be described, the invention relates to a click and a toothed wheel of an automaton device or automatic winding device of a timepiece movement. According to this embodiment, the click is designed to cooperate with the teeth of the toothed wheel. More particularly, the click is pivoted so as to cooperate with the teeth of the toothed wheel by means of beaks in particular positioned at its ends. Alternatively, the click could be designed to cooperate with teeth and/or a cam of the automatic winding device, with or without return spring. More generally, this invention could be implemented on any other component of a winding device that is subjected to friction, in particular on any pair of metal components comprising an interface that generates high-frequency friction. It could for example be implemented on a ratchet click of a winding device, whether it is a manual or automatic winding device.

Figure 1:
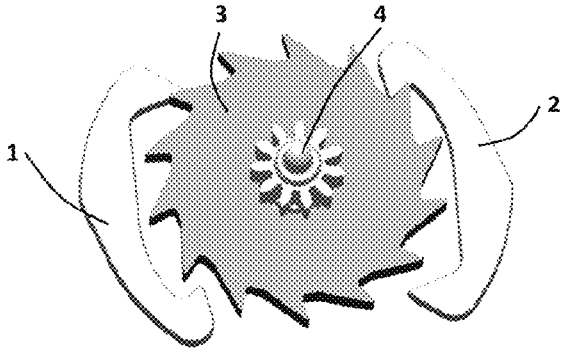
Fig. 1 PRIOR ART
FIG. 1 represents a portion of a mobile element of a kinematic chain of a winding device of the prior art.
Figure 2:
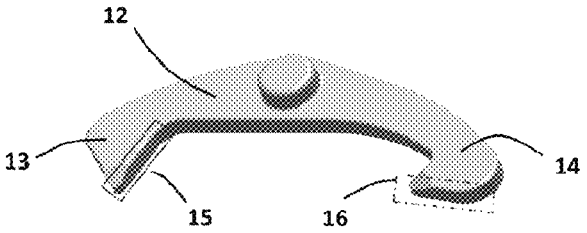
FIG. 2 represents a click of a mobile element of a kinematic chain of a winding device according to one embodiment of the invention.

FIG. 2 illustrates a click 12 of a winding device according to one embodiment of the invention. This click comprises two beaks 13, 14 at its two ends, which cooperate alternately with a toothed wheel, such as the toothed wheel 3 of FIG. 1, according to the three modes of operation used for the winding, as explained above. On each of these beaks 13, 14, a friction surface 15, 16 of a functional zone which is subjected to the friction torque with the toothed wheel has respectively been identified.

In order to overcome these phenomena, the embodiment proposes to manufacture the click 12 from an austenitic stainless steel, for example a steel of 316L type, the friction surfaces 15, 16 of which are subjected to a particular treatment that consists in diffusing carbon or nitrogen atoms over a given depth. This click is designed to cooperate with a conventional toothed wheel, for example made of 20AP or Finemac type steel.

The process for manufacturing such a click according to the embodiment comprises the following steps:

- stamping the click from a 316L austenitic stainless steel strip;
- treating at least one friction surface of the click, consisting in diffusing reinforcing atoms of carbon or nitrogen type into the crystal lattice of the steel over a predetermined depth, preferably between 5 and 40 microns inclusive. This treatment may consist in subjecting the timepiece to a gas (methane or propane for carburization, ammonia or molecular nitrogen for nitridation and a mixture of the two for nitrocarburization), at a temperature below 500° C., in order to prevent the formation of chromium carbides or chromium nitrides. By way of example, this treatment may consist of a Kolsterisation® or a thermochemical treatment such as a case hardening, a nitridation, a nitrocarburization, an ion implantation, a diffusion heat treatment, etc. This treatment is selected so as to obtain a hardening of the treated surfaces to a hardness greater than or equal to 1000 HV. Such a treatment is not described in detail since it is a question of using a technique known from the prior art.

Advantageously, the process comprises a polishing step between the preceding two steps. It also advantageously comprises a final polishing step after the treatment step, the role of which is to flatten the friction surfaces, for example over 2-3 μm, in order to make the treated surfaces perfectly smooth.

FIGS. 5*a* and 5*b* illustrate the friction surfaces observed after the same aging protocol of the click according to the embodiment as that of the prior art illustrated in FIGS. 3*a* and 3*b*. It is clearly apparent that the friction surfaces of the click according to the embodiment of the invention now have hardly any dark zones, unlike the observation described with reference to FIGS. 3*a* and 3*b*. Furthermore, the chemical analysis, the results of which are illustrated by FIG. 6, shows that the few dark marks are due to oxide of iron and/or of chromium, in particular chromite ($FeCr_2O_4$), which is responsible for the superior oxidation resistance of the click according to the embodiment during friction. As an observation, the iron oxide observed on the click is mainly formed on the toothed wheel then transferred to the surface of the click.

FIG. 7 also illustrates the effect obtained with the winding device according to the embodiment. This figure represents the torques measured on a winding device of the prior art, between a Ck60 steel click combined with a 20AP steel toothed wheel, by the bars, 21, 31, 41, 51, 61, 71 in a new state respectively for several speeds at the ratchet and by the bars 23, 33, 43, 53, 63, 73 in an aged state respectively for the various speeds at the ratchet, compared to the torques measured on the winding device according to the embodiment of the invention, by the bars 22, 32, 42, 52, 62, 72 in a new state respectively for the various speeds at the ratchet and by the bars 24, 34, 44, 54, 64, 74 in an aged state respectively for the various speeds at the ratchet. The aging was obtained by manually winding the watch by the stem, which corresponds to the third mode of operation of the device, thus giving rise to the rotation of the toothed wheel and its friction against the click which oscillates according to its pivot axis. As an observation, it is a question here of the harshest wear conditions for the clicks since they are always in unclicked configuration and oscillate, in particular rub, at high speed against the toothed wheel.

FIG. 7 shows that before aging, the torque measured for the components according to the embodiment of the invention is very slightly lower than that measured for the components of the prior art. After aging, the gap between the two measurements becomes very significant. The components according to the embodiment of the invention have a torque reduction whereas the components of the prior art have a radical increase in the torque measured, which illustrates their significant reduction in performance over time.

Thus, against all expectations, the solution used by the embodiment of the invention even makes it possible to reduce the friction torques over time, which enables the winding device to improve its performance while aging. This effect is very advantageous since it makes it possible, for example, to compensate for the aging of the winding system linked to the wear of other components. Another advantage of the invention originates from the fact that the timepiece movement winding device is less sensitive to magnetism due to the materials used.

The embodiment has been described using a click made of treated austenitic stainless steel, combined with a standard wheel. As a variant, the wheel may likewise be made of austenitic stainless steel, and its teeth, at least their friction surfaces, may be hardened by a treatment as described above.

Moreover, the austenitic stainless steel selected in the embodiment is of 316L type, but any other austenitic stainless steel could be used, such as 304L or 904L.

Naturally, the invention is not limited to the winding device described and could as a variant be implemented on any other metal component of a winding device that has any other structure, more specifically on at least one of its components that is subjected to frictional wear.

The invention also relates to a timepiece movement that comprises a winding device, in particular an automatic winding device, as described above. It also relates to a timepiece, such as a wristwatch, which comprises such a timepiece movement.

Moreover, the invention may more generally be extended to any metal component of a timepiece movement subjected to significant friction against another metal component, for example a lever, in particular a lever beak which is designed to cooperate with a cam, in particular within the context of a retrograde mechanism. It may also be implemented on the links of a steel strap, which are also subjected to a lot of friction through contact with their axes of rotation.

The invention claimed is:

1. A winding device of a timepiece movement, comprising:

first and second metal components that cooperate through an interface that is subjected to friction, wherein at least the first of the metal components is an austenitic stainless steel component, wherein the first of the metal components comprises at least one first metal friction surface, wherein the second of the metal components comprises at least one second metal friction surface, the at least one first metal friction surface being configured to be subjected to friction against the at least one second metal friction surface at the interface, wherein the at least one first metal friction surface is hardened by carbon or nitrogen type atoms introduced into the austenitic stainless steel over a predetermined depth, and wherein the first and second metal friction surfaces of the first and second metal components are configured to be subjected to friction at the interface at a rate of at least 5 kHz.

2. The winding device as claimed in claim 1, wherein the predetermined depth is between 5 and 40 μm inclusive.

3. The winding device as claimed in claim 2, wherein the at least one hardened fiction surface has a hardness greater than or equal to 1000 HV.

4. The winding device as claimed in claim 3, wherein the austenitic stainless steel is of 316L, 304L or 904L type.

5. The winding device as claimed in claim 3, wherein one of the first and second components is a click and the other of the first and second components is a toothed wheel cooperating with the click.

6. The winding device as claimed in claim 2, wherein the austenitic stainless steel is of 316L, 304L or 904L type.

7. The winding device as claimed in claim 2, wherein one of the first and second components is a click and the other of the first and second components is a toothed wheel cooperating with the click.

8. The winding device as claimed in claim 1, wherein the at least one hardened fiction surface has a hardness greater than or equal to 1000 HV.

9. The winding device as claimed in claim 8, wherein the austenitic stainless steel is of 316L, 304L or 904L type.

10. The winding device as claimed in claim 8, wherein one of the first and second components is a click and the other of the first and second components is a toothed wheel cooperating with the click.

11. The winding device as claimed in claim 1, wherein the austenitic stainless steel is of 316L, 304L or 904L type.

12. The winding device as claimed in claim 11, wherein one of the first and second components is a click and the other of the first and second components is a toothed wheel cooperating with the click.

13. The winding device as claimed in claim 1, wherein one of the first and second metal components is a click and the other of the first and second metal components is a toothed wheel cooperating with the click.

14. A timepiece movement comprising a winding device as claimed in claim 1.

15. A timepiece comprising a timepiece movement as claimed in claim 14.

16. A process for manufacturing a timepiece movement winding device, wherein the process comprises:

manufacturing at least one metal component, wherein the manufacturing comprises:

forming the component into an austenitic stainless steel strip; and treating at least one friction surface of the component obtained, wherein the treating comprises integrating reinforcing atoms of carbon or nitrogen type over a predetermined depth, so as to obtain the timepiece movement winding device as claimed in claim 1.

17. The process for manufacturing a winding device as claimed in claim 16, wherein the treating comprises subjecting the timepiece to a gas at a temperature below 500° C., in order to prevent the formation of chromium carbides or chromium nitrides, or to a thermochemical treatment.

18. The process for manufacturing a winding device as claimed in claim 17, comprising polishing, wherein the polishing is performed at least one of (i) between the forming and treating and (ii) on at least one treated friction surface after treating.

19. The process for manufacturing a winding device as claimed in claim 16, comprising polishing, wherein the polishing is performed at least one of (i) between the forming and treating and (ii) on at least one treated friction surface after treating.

20. The process for manufacturing a winding device as claimed in claim 16, wherein the treating comprises subjecting the timepiece to a gas, wherein the gas is selected from the group consisting of a carburization gas selected from methane and propane for a carburization, a nitrididation gas selected from ammonia and molecular nitrogen for a nitridation, and a mixture of a carburization gas selected from methane and propane and a nitridation gas selected from ammonia and molecular nitrogen for a nitrocarburization.

21. The process for manufacturing a winding device as claimed in claim 16, wherein the treating comprises subjecting the timepiece to a thermochemical treatment selected from the group consisting of a case hardening, a nitridation, a nitrocarburization, an ion implantation, and a diffusion heat treatment.

* * * * *